United States Patent [19]

Noé et al.

[11] Patent Number: 4,470,284

[45] Date of Patent: Sep. 11, 1984

[54] APPARATUS FOR ADJUSTING ROLLS OF ROLL STAND

[75] Inventors: Oskar Noé, Mühlheim-Ruhr; Rolf Noé, Berlin-Charlottenburg; Andreas Noé, Aachen-Richterich, all of Fed. Rep. of Germany

[73] Assignee: BGW Bergwerk- und Walzwerk-Maschinenbau GmbH, Duisburg, Fed. Rep. of Germany

[21] Appl. No.: 378,415

[22] Filed: May 14, 1982

[30] Foreign Application Priority Data

May 15, 1981 [DE] Fed. Rep. of Germany ..... 3119407

[51] Int. Cl.[3] ..... B21B 31/24; B65H 17/22; F16H 37/06

[52] U.S. Cl. ..... 72/248; 226/177; 74/675; 74/665 C; 74/665 GB; 74/665 M; 74/665 N

[58] Field of Search ..... 74/661, 664, 665 A, 74/665 C, 665 F, 665 H, 665 L, 665 M, 665 N, 665 Q, 665 B, 665 GB, 674, 675; 226/177, 176, 174; 198/807, 816, 782; 72/248

[56] References Cited

U.S. PATENT DOCUMENTS

| | | | |
|---|---|---|---|
| 1,825,957 | 10/1931 | Johnson | 72/248 |
| 2,106,965 | 12/1933 | Wright et al. | 72/248 |
| 2,339,359 | 1/1944 | Shayre et al. | 72/248 |
| 2,684,001 | 7/1954 | Wilson | 72/248 X |
| 3,017,665 | 1/1962 | Dasher et al. | 72/248 X |
| 3,161,083 | 12/1964 | Roe | 74/675 |
| 3,216,231 | 11/1965 | Granborg | 72/248 |
| 3,251,442 | 5/1966 | Aschauer | 74/675 |
| 4,341,132 | 7/1982 | Burdick | 74/681 |

FOREIGN PATENT DOCUMENTS

| | | | |
|---|---|---|---|
| 407760 | 3/1934 | United Kingdom | 74/675 |
| 877107 | 9/1961 | United Kingdom | 74/675 |

*Primary Examiner*—Allan D. Herrmann
*Assistant Examiner*—Stephen B. Andrews
*Attorney, Agent, or Firm*—Karl F. Ross; Herbert Dubno

[57] ABSTRACT

An apparatus for positioning a roll of a roll stand has respective adjustment spindles operatively engageable with the ends of the roll and rotatable about respective axes in one direction to advance the respective roll end and in an opposite direction to retract the respective roll end. A main transmission has respective rotary outputs connected to the spindles, main inputs, and secondary inputs and a relatively strong main drive has respective rotary output shafts connected to the main inputs of the main transmissions for rotating the spindles therethrough. Respective secondary transmissions have outputs connected to the secondary input of the main transmissions and inputs. Individually operable respective relatively weak secondary drives are connected to the inputs of the secondary transmissions for rotating same and rotating the spindles through the secondary and main transmissions. Respective brakes are engageable with the outputs of the main transmission for arresting same while the secondary drives are operating.

10 Claims, 1 Drawing Figure

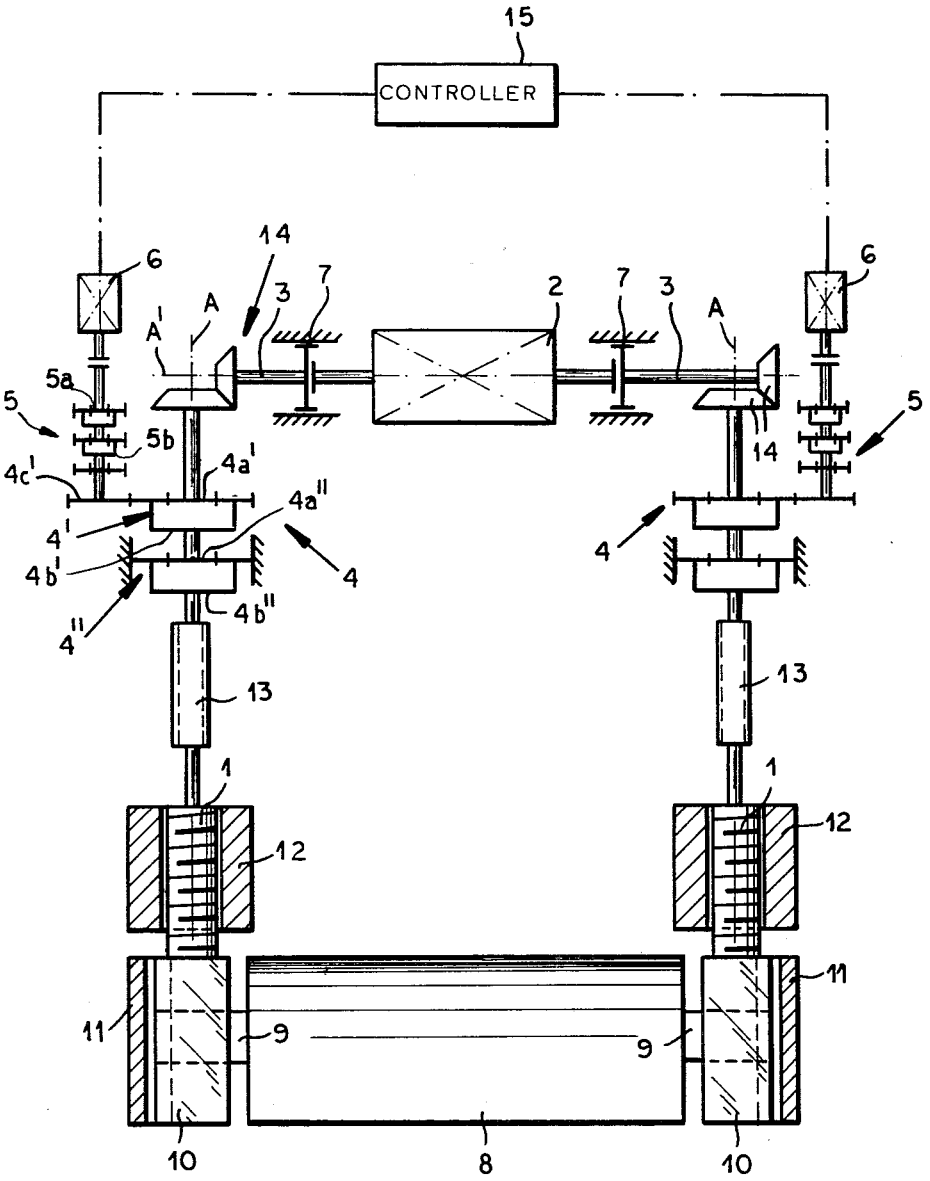
15
CONTROLLER
14
6
7
3
2
A
A'
5a
5
5b
4c'
4a'
4a''
4'
4b'
4
4b''
4''
13
1
12
11
9
10
8

APPARATUS FOR ADJUSTING ROLLS OF ROLL STAND

FIELD OF THE INVENTION

The present invention relates to an apparatus for adjusting roll position in a roll stand. More particularly this invention concerns such an apparatus usable in a steel-rolling mill to set roll spacing between runs or even during a run.

BACKGROUND OF THE INVENTION

At least one roll of a standard double roll stand has its ends carried in journal blocks that can slide in normally vertical guides of the roll-stand frame. In order to adjust roll spacing either between runs or during a run it is necessary to displace at least one of the rolls relative to the other. To do this enormous pressures must be brought to bear between these blocks and the frame.

Thus a system is known where each side of the frame is provided with a coaxial drive arrangement formed by a coaxial heavy-duty motor and transmission, and a spindle threaded in a nut in the frame. Each spindle is fixed to the respective transmission output and is coupled to the respective journal block so that when the spindle is rotated by the motor through the transmission in one direction it advances the respective block and when rotated oppositely it retracts it. Such a system is quite bulky and expensive. It is necessary to trade off between adjustment speed and accuracy of placement, as the single drive can not make fine adjustments if it is built for high-speed adjustment and vice versa.

Thus systems have been developed with separate coarse- and fine-adjustment drives having respective drive motors. The coarse-adjustment drive rotates a shaft parallel to the roll being adjusted and is connected to the spindles at the ends of this roll by means of bevel-gear systems and appropriate transmissions. This main drive motor is connected via a clutch to this transverse main shaft, and the secondary drive motor for fine adjustment is connected via a stepdown transmission to it also.

Thus the heavy-duty motor can be effective to approximately set the roll position, at high speed, then it is disconnected and the secondary drive motor is connected up to the main drive shaft so it can make the last adjustments at slow speed. Such a system is quite complex, as the clutches must be able to transmit considerable torque, so they are bulky and expensive. In addition the necessary structure for such a system is quite large, making it difficult to fit such a system to the roll stand which itself is quite bulky.

OBJECTS OF THE INVENTION

It is therefore an object of the present invention to provide an improved apparatus for adjusting a roll of a roll stand.

Another object is the provision of such a apparatus for adjusting a roll of a roll stand which overcomes the above-given disadvantages.

SUMMARY OF THE INVENTION

These objects are attained according to the instant invention in an apparatus for positioning a roll of a roll stand which has, as described above, respective adjustment spindles operatively engageable with the ends of the roll and rotatable about respective axes in one direction to advance the respective roll end and in an opposite direction to retract the respective roll end. According to this invention a main transmission has respective rotary outputs connected to the spindles, main inputs, and secondary inputs and a relatively strong main drive has respective rotary output shafts connected to the main inputs of the main transmissions for rotating the spindles therethrough. Respective secondary transmissions have outputs connected to the secondary inputs of the main transmissions and inputs. Individually operable respective relatively weak secondary drives are connected to the inputs of the secondary transmissions for rotating same and rotating the spindles through the secondary and main transmissions. Finally, respective brakes are engageable with the outputs of the main transmission for arresting same while the secondary drives are operating.

Thus the system of this invention completely eliminates the need of any expensive clutches. Brakes powerful enough to arrest a shaft rotating with a certain speed and torque are much simpler and cheaper than clutches capable of transmitting such torque at such speeds. This system further has the considerable advantage that all drive motors can be operated simultaneously, giving a total adjustment speed that is higher than anything hitherto used. Then the main drive motor can be shut off and its outputs braked, and the secondary drive motors will continue the advance or retraction of the roll, but at a much slower speed for high accuracy. In the fine-adjustment mode the force that the system can exert is considerable, in fact greater than in the high-speed coarse-adjustment mode, as the relatively weak secondary drive motors are stepped down so that they can in fact exert greater pressure at the spindle than the stronger coarse-adjustment main drive motor.

According to this invention at least the secondary transmissions are stepdown planetary-gear transmissions. The stepdown planetary-gear transmissions constituting the main transmissions have several stages the first of which has a part forming the respective secondary input.

Normally according to the invention the main drive is a single motor having a single shaft forming both of the rotary outputs and the main transmissions are multistage planetary gear transmissions having several stages the first of which has one part forming the respective main input and another part forming the respective secondary input. The secondary transmissions and usually also the main transmissions are of the one-way type whose input substantially cannot be driven by its output. Such use of planetary-gear transmissions therefore has several advantages. First of all it is possible for the transmissions to be coaxial with the respective motors or shafts so that they are quite compact and convenient to use. A considerable speed stepdown and torque stepup can be achieved in a small space by a planetary-gear transmissions. Finally such planetary-gear transmission can easily be of the self-jamming or one-way type, that is transmissions which can act as brakes on their output shafts. Only rotation of the input shaft can drive the transmission, when torque is exerted on the output shaft which normally is fixed to the planet carrier it will not be transmitted backward through the transmission to rotate the input shaft, even if same is free to rotate.

The spindle axes according to this invention are parallel and the rotary outputs are coaxial and transverse to these axes. Although the main drive can be two separate motors, normally one motor with two shaft ends is used.

Thus the main drive are shafts and the brakes are engaged with the shafts. Right-angle drives are provided between the main drive shaft and the main inputs of the two main transmissions, which themselves are coaxial with the respective spindles. The secondary transmissions and drive motors are normally centered on respective axes parallel to but offset horizontally from the respective spindle axes. The main and secondary inputs of the main transmissions are both parts of the first stages thereof, and may in fact mesh with other. Normally one is the sun gear and the other may be the ring gear.

DESCRIPTION OF THE DRAWING

The above and other features and advantages will become more readily apparent from the following, reference being made to the accompanying drawing whose sole FIGURE is a schematic representation of the apparatus of this invention.

SPECIFIC DESCRIPTION

As seen in the drawing, a roll 8 of two-roll roll stand has end gudgeons 9 supported in journal blocks 10 slidable in guides 11 of the frame 12 of the stand. Respective threaded spindles 1 threaded in the frame 12 bear on these blocks 10 and have respective axes A about which they can rotate in one direction to advance the respective roll end 9 and in the opposite direction to retract it.

A main 15-kw drive motor 2 has single shaft extending along an axis A' perpendicular to the axes A and whose two opposite ends 3 are connected via bevel-gear right-angle drives 14 to inputs 4a' of respective planetary-gear transmissions 4 having two stages 4' and 4''. Normally each shaft 4a' carries the sun gear of the respective first stage 4'.

The first stage 4' of each transmission 4 also has an output 4b' formed by its planet carrier and a secondary input 4c' which may mesh with or be formed by the ring gear. Each secondary input 4c' is connected to the output 5b of a three-stage planetary-gear transmission 5 whose input 5a in turn is connected to a 5-kw secondary drive motor 6. The second stage 4'' of each transmission 4 has an input 4a'' connected to the output 4b' and an output 4b'' connected via a coupling 13 to the respective spindle 1. The transmissions 4 are centered on the respective axes A.

The transmissions 4 and 5 are of the so-called one-way stepdown type, as is common with planetary-gear transmissions. This means that when the input is driven there is a considerable stepdown of rotation speed at the output shaft, which rotates much more slowly but with much greater torque. When the output is rotated, however, the transmission normally binds and the input does not turn at all. No such one-way action is effective between the two inputs 4a' and 4c' of the transmission 4. Nonetheless the input 4c' is connected to the output of the one-way transmission 5 so that, unless the respective motor 6 is driving its input, this element 4c' will be fixed.

The input 4a' can be arrested only be a respective electromagnetic brake 7 of the multileaf type engaged on the synchronously rotating ouput shaft 3 of the motor 2. Thus during fast coarse adjustment the motors 5 and 6 are all operated by a controller 15 to advance the spindles 1 at high speed and with great force in the respective direction. Relatively fast speed can be achieved by operation of the motor 2 alone, and in that case the transmissions 5 must be of the one-way type. For fine adjustment the motor 2 is stopped and the brakes 7 are applied and only the motors 6 are operated, allowing individual control at each roll end 9. The force of the smaller motors 6 is stepped down before it is even applied to the inputs 4c'. Nonetheless it is possible to exert forces of as much as 600 tons on the spindles 1 by the motors 6.

The system of the instant invention, therefore, allows fast coarse adjustment and relatively fast fine adjustment. The roll ends can be individually adjusted, and can even be adjusted in opposite directions. The range of adjustment further is not limited to one immediately surrounding the position set by the coarse adjustment, but instead from any starting position the fine-adjustment motors 6 can move the respective spindles 1 through their entire strokes.

We claim:

1. An apparatus for positioning a roll of a roll stand, said apparatus comprising:

respective adjustment spindles operatively engageable with the ends of said roll and rotatable about respective axes in one direction to advance the respective roll end and in an opposite direction to retract the respective roll end;

respective main transmissions having respective rotary outputs connected to said spindles, main inputs, and secondary inputs;

means including a heavy-duty main drive having respective rotary output shafts connected to said main inputs of said main transmissions for rotating said spindles therethrough;

respective secondary transmissions having outputs connected to said secondary inputs of said main transmissions and inputs;

means including individually operable respective light-duty secondary drives connected to said inputs of said secondary transmissions for rotating these secondary-transmission inputs and for rotating said spindles through said secondary and main transmissions; and means including respective brakes engageable with said inputs of said main transmission for arresting these main-transmission inputs while said secondary drives are operating.

2. The apparatus defined in claim 1 wherein said secondary transmissions are stepdown planetary-gear transmissions.

3. The apparatus defined in claim 1 wherein all of said transmissions are stepdown planetary-gear transmissions, the stepdown planetary-gear transmissions constituting said main transmissions having several stages the first of which has a part forming the respective secondary input.

4. The apparatus defined in claim 1 wherein said brakes are electromagnetically operated.

5. The apparatus defined in claim 4 wherein said rotary outputs of said main drive are shafts engageable by said brakes.

6. The apparatus defined in claim 1 wherein said main drive is a single motor having a single shaft forming both of said rotary output shafts.

7. The apparatus defined in claim 1 wherein said main transmissions are multistage planetary gear transmissions having several stages the first of which has one part forming the respective main input and another part forming the respective secondary input.

8. The apparatus defined in claim 1 wherein said secondary transmissions are of the one-way type whose input substantially cannot be driven by its output.

9. The apparatus defined in claim 1 wherein said main transmissions are of the one-way type whose input substantially cannot be driven by its output.

10. The apparatus defined in claim 1 wherein said axes are parallel and said rotary output shafts are coaxial and transverse to said axes.

* * * * *